US006689232B2

(12) United States Patent
Bhargava

(10) Patent No.: US 6,689,232 B2
(45) **Date of Patent: *Feb. 10, 2004**

(54) COPPER ALLOY

(76) Inventor: Ashok K. Bhargava, 393 Charles Dr., Cheshire, CT (US) 06410

( * ) Notice: Subject to any disclaimer, the term of this patent is extended or adjusted under 35 U.S.C. 154(b) by 98 days.

This patent is subject to a terminal disclaimer.

(21) Appl. No.: 09/800,989

(22) Filed: Mar. 7, 2001

(65) Prior Publication Data

US 2001/0009168 A1 Jul. 26, 2001

Related U.S. Application Data

(62) Division of application No. 09/325,036, filed on Jun. 7, 1999, now Pat. No. 6,241,831.

(51) Int. Cl.[7] ..... C22C 9/04

(52) U.S. Cl. ..... 148/554; 148/681; 148/682; 148/684; 148/685

(58) Field of Search ..... 148/554, 681, 148/682, 684, 685

(56) References Cited

U.S. PATENT DOCUMENTS

| | | | | |
|---|---|---|---|---|
| 2,171,697 A | | 9/1939 | Hensel et al. | 75/153 |
| 3,677,745 A | | 7/1972 | Finlay et al. | 75/153 |
| 4,427,627 A | | 1/1984 | Guerlet et al. | 420/496 |
| 4,605,532 A | * | 8/1986 | Knorr et al. | 148/685 |
| 4,750,029 A | | 6/1988 | Futatsuka et al. | 357/67 |
| 4,859,417 A | | 8/1989 | Innocenti | 420/493 |
| 5,004,520 A | | 4/1991 | Tsuji et al. | 156/630 |
| 5,667,752 A | | 9/1997 | Suzuki et al. | 420/494 |
| 5,868,877 A | | 2/1999 | Brenneman | 148/432 |
| 5,893,953 A | * | 4/1999 | Bhargava | 148/685 |
| 5,916,386 A | * | 6/1999 | Bhargava | 148/554 |

FOREIGN PATENT DOCUMENTS

| | | | |
|---|---|---|---|
| EP | 0 908 526 | 4/1999 | C22C/9/04 |
| EP | 0 841 408 | 11/2001 | C22C/9/02 |
| JP | 53-19920 | 2/1978 | C22C/9/10 |
| JP | 55-47337 | 4/1980 | C22C/9/00 |
| JP | 58-199835 | 11/1983 | C22C/9/00 |
| JP | 59-232244 | 12/1984 | C22C/9/00 |
| JP | 1-263238 | 10/1989 | C22C/9/00 |
| JP | 6-73474 | 3/1994 | C22C/9/04 |
| JP | 10-195562 | 7/1998 | C22C/9/00 |
| JP | 11-80863 | 3/1999 | C22C/9/02 |
| WO | 02/00949 | 1/2002 | |

OTHER PUBLICATIONS

Patent Application Publication, Pub. No. US 2001/0010243, Aug. 2, 2001.*

* cited by examiner

*Primary Examiner*—Sikyin Ip

(57) ABSTRACT

The present invention relates to copper-magnesium-phosphorous alloys. In a first embodiment, copper-magnesium-phosphorous alloys in accordance with the present invention consist essentially of magnesium in an amount from about 0.01 to about 0.25% by weight, phosphorous in an amount from about 0.01 to about 0.2% by weight, silver in an amount from about 0.001 to about 0.1% by weight, iron in an amount from about 0.01 to about 0.25% by weight, and the balance copper and inevitable impurities. Preferably, the magnesium to phosphorous ratio is greater than 1.0. In a second embodiment, copper-magnesium-phosphorous alloys in accordance with the present invention consist essentially of magnesium in an amount from about 0.01 to about 0.25% by weight, phosphorous in an amount from about 0.01 to about 0.2% by weight, optionally silver in an amount from about 0.001 to about 0.1% by weight, at least one element selected from the group consisting of nickel, cobalt, and mixtures thereof in an amount from about 0.05 to about 0.2% by weight, and the balance copper and inevitable impurities.

14 Claims, 1 Drawing Sheet

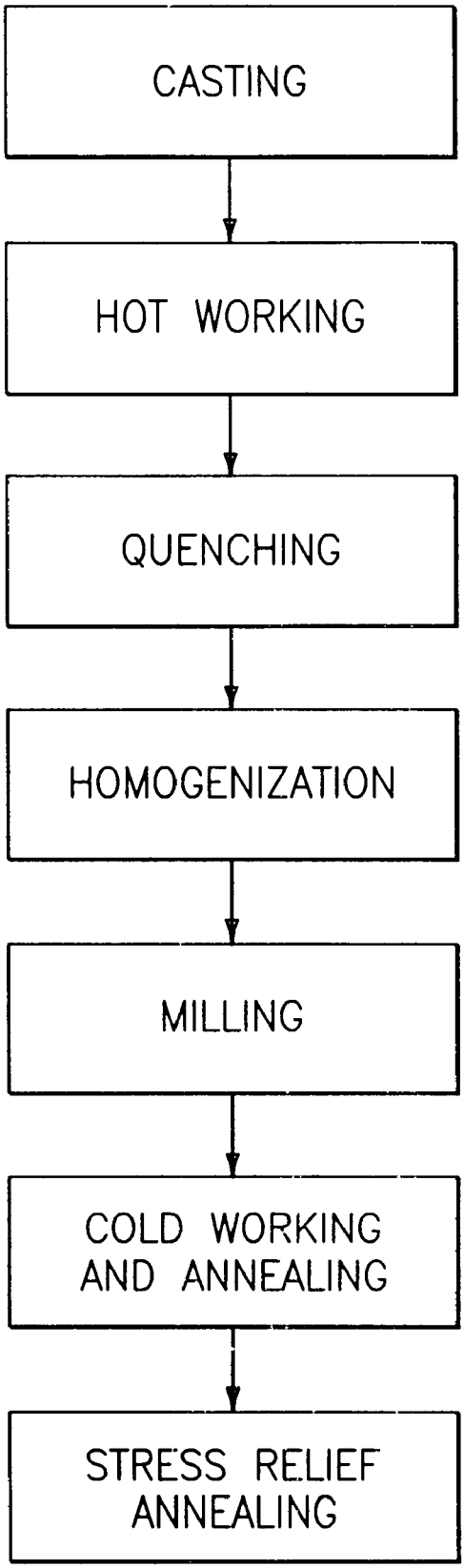
CASTING
HOT WORKING
QUENCHING
HOMOGENIZATION
MILLING
COLD WORKING AND ANNEALING
STRESS RELIEF ANNEALING

COPPER ALLOY

This is a Division, of application Ser. No. 09/325,036 , filed Jun. 7, 1999 now U.S. Pat. No. 6,241,831.

BACKGROUND OF THE INVENTION

The present invention relates to copper alloys containing magnesium and phosphorous and which exhibit electrical conductivity of 90% IACS or higher and significantly higher strength properties.

Historically, copper has been strengthened by alloying with different elements. With very few exceptions, the additions have sacrificed electrical conductivity properties disproportionately while increasing strength properties. Pure copper, which peaks at a tensile strength on the order of 60 ksi, has an electrical conductivity of 100% IACS at this strength. Thus, pure copper has a strength×conductivity factor of 6,000 (60×100) units. Brasses, one of the oldest of copper alloy families, while capable of acquiring strength as high as 104 ksi, typically incur a large decrease in conductivity. Cartridge brass, the most popular of the brasses, has a strength×conductivity factor of under 3,000 units. Other alloys such as bronzes and copper-nickel alloys have strength×conductivity factors that are well below that of pure copper.

Alloys with low element additions, that have electrical conductivities around 90% IACS, have the best combination of strength and conductivity. Zirconium coppers, for example, are capable of producing strips with a strength of 70 ksi with a corresponding electrical conductivity of 90% IACS. The strength×conductivity factor of these alloys peaks around 6300 units. However, these alloys are very difficult to produce, suffer from very high variations in properties, and do not exhibit good formability.

Alloys containing magnesium and phosphorous are known in the art. U.S. Pat. No. 3,677,745 to Finlay et al., for example, illustrates a copper alloy containing 0.01 to 5.0 weight percent magnesium, 0.002 to 4.25 weight percent phosphorous and the balance copper. This patent also illustrates copper-magnesium-phosphorous alloys having optional additions of silver and/or cadmium in amounts of from 0.02 to 0.2 weight percent and 0.01 to 2.0 weight percent, respectively.

Alloys of the Finlay et al. type are capable of achieving properties as follows:

i) Tensile strength (T.S.) 90 ksi with 70% IACS conductivity (strength×conductivity factor=6,300);

ii) T.S. 55 ksi with 95% IACS conductivity (strength× conductivity factor=5,225); and iii) T.S. 80 ksi with 70% IACS conductivity (strength× conductivity factor=5,600).

Alloys such as these represent the best combinations of strength and conductivity, in some cases exceeding that of pure copper. These alloys have good formability; however, their resistance to heat is limited. High conductivity alloys are used in applications where they are exposed to high temperatures for short durations. These alloys while capable of retaining a significant part of their strength at 710° F., lose an unacceptable part of their strength when exposed to temperatures such as 800° F., even for a few minutes.

U.S. Pat. No. 4,605,532 to Knorr et al. illustrates an alloy which consists essentially of from about 0.3 to 1.6% by weight iron, with up to one half of the iron content being replaced by nickel, manganese, cobalt, and mixtures thereof, from about 0.01 to about 0.2% by weight magnesium, from about 0.10 to about 0.40% phosphorous, up to about 0.5% by weight tin or antimony and mixtures thereof, and the balance copper. The Knorr et al. alloys are based on a high phosphorous to magnesium ratio which is at least 1.5:1 and preferably above 2.5:1. The result of this is that whereas all the magnesium in the Knorr et al. alloys is likely to be tied up with phosphorous, other elements like iron and cobalt will be left in solution in large amounts. As a consequence, electrical conductivity will suffer. The Knorr et al. alloys also contain coarse particles having a size in the range of 1 to 3 microns. As a result, the Knorr et al. alloys will exhibit poorer ductility, formability, resistance to softening, and lower strength×conductivity factors.

U.S. Pat. No. 4,427,627 to Guerlet et al. relates to a copper alloy essentially comprising 0.10 to 0.50% by weight cobalt, 0.04 to 0.25% by weight phosphorous, and the remainder copper. The cobalt and phosphorous additions are made so that the ratio of cobalt to phosphorous is between 2.5:1 and 5:1, preferably 2.5:1 and 3.5:1. Nickel and/or iron may be substituted for part of the cobalt; however, the nickel and iron may not be present in an amount greater than 0.15% with nickel being present in an amount less than 0.05% by weight and the iron being present in an amount less than 0.10% by weight. The Guerlet et al. alloys may contain one or more of the following additions: from 0.01 to 0.35%, preferably 0.01 to 0.15%, by weight magnesium; from 0.01 to 0.70%, preferably 0.01 to 0.25% by weight cadmium; from 0.01 to 0.35%, preferably 0.01 to 0.15% silver; from 0.01 to 0.70, preferably 0.01 to 0.2% by weight zinc; and from 0.01 to 0.25%, preferably 0.01 to 0.1% by weight tin. The alloys of this patent suffer from the deficiency that the importance of forming magnesium phosphide and/or iron phosphide particles of particular sizes to improve physical properties such as formability, ductility, and resistance to softening while maintaining high strength properties and electrical conductivity is not recognized.

U.S. Pat. No. 4,750,029 to Futatsuka et al. illustrates a copper base lead material for semiconductor devices. The material consists essentially of from about 0.05 to 0.25% by weight tin, from 0.01 to 0.2% by weight silver, from 0.025 to 0.1% by weight phosphorous, from 0.05 to 0.2% magnesium, and the balance copper and inevitable impurities. The P/Mg ratio is within a range from 0.60 to 0.85 so as to form a compound of magnesium and phosphorous or $Mg_3P_2$. Alloys of this type are typically marked by a low strength×conductivity factor.

Other copper-magnesium-phosphorous alloys are illustrated in Japanese patent document 55-47337 and Japanese patent document 59-20439. The '337 patent document illustrates a copper alloy containing 0.004 to 0.7% phosphorous, 0.01 to 0.1% magnesium, 0.01 to 0.5% chromium, and the balance copper. Alloys of this type exhibit electrical conductivities in the range of 80 to 90% IACS in an annealed condition; however, the strength×conductivity factors are less than desirable. The '439 patent document illustrates a copper alloy containing 2 to 5% iron, 0.2 to 1.0% magnesium, 0.3 to 1.0% phosphorous and the balance copper. Alloys of this type enjoy high strength properties and very low electrical conductivities.

Japanese patent document 53-19920 relates to a copper alloy containing 0.004 to 0.04% phosphorous, 0.01 to 02.0% of one or more of magnesium, silicon, manganese, arsenic, and zinc, and the balance copper. While alloys within these ranges enjoy electrical conductivities in the range of 80 to 90% IACS, they suffer from low strength properties.

U.S. Pat. No. 2,171,697 to Hensel et al. relates to a copper-magnesium-silver alloy. The silver is present in an amount from 0.05 to 15%, while the magnesium is present in an amount from 0.05 to 3%. This patent, on its first page, notes that copper-magnesium alloys containing small proportions of beryllium, calcium, zinc, cadmium, indium, boron, aluminum, silicon, titanium, zirconium, tin, lead, thorium, uranium, lithium, phosphorous, vanadium, arsenic, selenium, tellurium, manganese, iron, cobalt, nickel, and chromium, can be improved by the addition of silver in the aforesaid range. Certainly, there is no recognition in this patent of the need to form magnesium phosphides and/or iron phosphides to provide a very desirable set of physical properties.

Recently, Olin Corporation has issued U.S. Pat. No. 5,868,877. This patent is directed to a copper-iron-magnesium-phosphorous alloy having the same composition as Olin's prior art alloy C197. Olin also has developed certain new alloys, designated 19710 and 19720, which have entered the market place. These alloys contain phosphorous, magnesium, iron, nickel, cobalt and/or manganese, but do not contain any silver. Alloy 19710 contains 0.03 to 0.6 weight % magnesium, 0.07 to 0.15% phosphorous, 0.05 to 0.40% iron. 0.1% max. nickel plus cobalt, 0.05% manganese, and the balance copper. Alloy 19720 contains 0.06 to 0.20% magnesium, 0.05 to 0.15% phosphorous, 0.05 to 0.50% iron, and the balance copper. The alloy designated 19720, per published data, has an electrical conductivity of 80% IACS in soft condition and a tensile strength of 60 to 70 ksi in hard temper.

Despite the existence of these alloys, there remains a need for alloys which demonstrate high electrical conductivity, high strength properties, and excellent ductility, formability, and resistance to softening.

SUMMARY OF THE INVENTION

Accordingly, it is an object of the present invention to provide copper alloys capable of reaching a tensile strength on the order of 80 ksi and possessing electrical conductivities of 90% IACS or greater.

It is also an object of the present invention to provide copper alloys as above which have equal or better formability as compared to similar alloys and as measured in terms of R/T (radius to thickness) ratios in bending.

It is also an object of the present invention to provide copper alloys as above which provide better ductility and resistance to softening.

The foregoing objects are attained by the copper alloys of the present invention.

In a first embodiment, copper-magnesium-phosphorous alloys in accordance with the present invention consist essentially of magnesium in an amount from about 0.01 to about 0.25% by weight, phosphorous in an amount from about 0.01 to about 0.2% by weight, silver in an amount from about 0.001 to about 0.1% by weight, iron in an amount from about 0.01 to about 0.25% by weight, and the balance copper and inevitable impurities. Preferably, the magnesium to phosphorous ratio is greater than 1.0.

In a second embodiment, copper-magnesium-phosphorous alloys in accordance with the present invention consist essentially of magnesium in an amount from about 0.01 to about 0.25% by weight, phosphorous in an amount from about 0.01 to about 0.2% by weight, optionally silver in an amount from about 0.001 to about 0.1% by weight, at least one element selected from the group consisting of nickel, cobalt, and mixtures thereof in an amount from about 0.05 to about 0.2% by weight, and the balance copper and inevitable impurities.

Other details of the copper alloys of the present invention, as well as the process for forming same, and other advantages and objects attendant thereto, are set forth in the following detailed description and the accompanying drawing(s) wherein like reference numerals depict like elements.

BRIEF DESCRIPTION OF THE DRAWING(S)

The FIGURE is a schematic representation of the processing of the copper alloys of the present invention.

DETAILED DESCRIPTION OF THE PREFERRED EMBODIMENT(S)

The alloys of the present invention are copper-magnesium-phosphorous alloys. They are characterized by high strength properties, high electrical conductivity, high strength×conductivity factors, improved ductility and formability, and improved resistance to softening.

The alloys in accordance with the present invention include in a first embodiment those copper base alloys consisting essentially of magnesium in an amount from about 0.01 to about 0.25% by weight, preferably from about 0.07% to about 0.15% by weight, phosphorous in an amount from about 0.01 to about 0.2% by weight, silver in an amount from about 0.001 to about 0.1% by weight, iron in an amount from about 0.01 to about 0.25% by weight, preferably from about 0.01% to about 0.2% by weight, and most preferably from about 0.01% to a maximum amount of about 0.05%, and the balance copper and inevitable impurities. These alloys typically have phosphide particles uniformly distributed throughout the alloy matrix, which phosphide particles have a peak size of approximately 0.2 microns. These phosphide particles, while strengthening the alloys, cause no harm to their formability and ductility.

These alloys may include at least one additional element selected from the group consisting of tin, silicon, and mixtures thereof. This at least one additional element may be included in amounts less than about 0.2% by weight. Typically, when one of these elements is added, it is added in a minimum amount of 0.001% by weight.

These alloys may also include up to 0.1% by weight of at least one additional element selected from the group consisting of boron, beryllium, calcium, chromium, zirconium, titanium, and mixtures thereof.

Still further, the alloys may include up to about 0.2% of an additional constituent selected from the group consisting of nickel, cobalt and, mixtures thereof. Preferred embodiments of the alloys of the present invention include from about 0.05% to about 0.2% of at least one of nickel and cobalt, and most preferably from about 0.11% to about 0.20% of at least one of nickel and cobalt.

Iron in the aforesaid amounts increases the strength of the alloys and promotes the production of a fine grain structure.

Nickel and/or cobalt in the aforesaid amounts are desirable additives since they improve strength by refining the grain and forming phosphides. Additionally, they have a positive effect on conductivity.

The aforesaid phosphorous addition allows the metal to stay deoxidized, making it possible to cast sound metal within the limits set for phosphorous. With thermal treatment of the cast alloys, phosphorous forms a phosphide with iron and/or iron and nickel and/or iron and magnesium and/or a combination of these elements which significantly reduces the loss in electrical conductivity that would result if these materials were entirely in solid solution in the matrix. For example, 0.01% phosphorous in solid solution would decrease the electrical conductivity by 8% IACS. 0.01% iron in solution would decrease the electrical conductivity by another 5.5% IACS. Thus, in order to achieve electrical conductivities of 90% IACS and greater, minimal amounts of iron and minimal amounts of phosphorous must be present in solution.

To accomplish the foregoing goal, magnesium is added to the alloys in the aforesaid ranges. The magnesium is further added so that the Mg:P ratio is at least 1.0 and preferably greater than 1.0. Further, the composition of alloying elements is selected so that the elements in order of effect on conductivity, P, Fe, Co(where added) are present to the maximum extent as phosphides with none or a minimal amount of them in solution. Magnesium, on the other hand, which causes minimal drop in electrical conductivity when left in solution, is added in a proportion which causes some residual amount of magnesium to be left in solution. This residual magnesium ensures that any phosphorous that is not tied up with elements like iron, cobalt and nickel, will be tied up by the magnesium (form magnesium phosphide particles).

It has been found that alloys formed in accordance with the present invention have negligible iron and only about 0.0036% by weight phosphorous (about 5% of the phosphorous added to the alloy) in solution. Still further, the alloys have approximately 0.035% by weight magnesium in solution. In comparison, a magnesium-phosphorus-silver-copper alloy containing 0.108% magnesium, 0.068% phosphorous, and 0.04% silver and the balance copper and inevitable impurities has approximately 0.0067% phosphorous (approximately 10% of the phosphorous addition) and approximately 0.037% magnesium in solution, resulting in a lower electrical conductivity.

The alloys of the present invention are optimally thermally treated to form magnesium phosphide particles in the range of about 500–about 2000 Angstroms and iron phosphide particles in two ranges, a coarse range having particles whose size is in the range of from about 1000–about 2000 Angstroms and a finer range having particles whose size is in the range of from about 250 to about 600 Angstroms. The magnesium phosphide particles and said iron phosphide particles are uniformly distributed throughout the alloy matrix. In a preferred embodiment of the alloys of the present invention, the ratio of coarse iron phosphide particles to fine iron phosphide particles is from about 1:3 to about 1:6. The presence of fine iron phosphide particles with the aforesaid size and distribution provide the alloys of the present invention with better ductility and formability. They also provide better resistance to softening since the finer particles allow one to have more particles for the same amount of alloying elements.

Alloys formed in accordance with the present invention, in a cold worked condition, exhibit a strength in excess of 80 ksi with an electrical conductivity of 90% IACS. The electrical conductivity of the alloys of the present invention, when in soft temper, can reach over 95% IACS.

Alloys in accordance with the present invention may be processed as shown in the FIGURE. The alloys may be cast using any suitable continuous or non-continuous casting technique known in the art. For example, the alloys could be cast using horizontal casting techniques, direct-chill casting techniques, vertical casting techniques, and the like. After casting the alloys may be hot worked at a temperature in the range of about 1200° F. to about 1600° F. to a desired gauge. The hot working may comprise any suitable technique known in the art including but not limited to hot rolling. Typical gauges for the material after hot working are in the range of from about 0.400 inches to about 0.600 inches.

Following hot working, the alloys may be quenched, if needed, and homogenized, if needed, at a temperature of from about 1200° F. to about 1600° F. for at least one hour. Thereafter, they may be milled to remove material from 0.020 inches to about 0.050 inches per side. Any quenching, homogenizing, and milling may be carried out using any suitable equipment and technique known in the art.

Following milling, the alloys of the present invention may be subjected to cold working, such as cold rolling from the milled to finish gauge, with at least one annealing operation in the temperature range of about 700° F. to about 1200° F. for a time ranging from 1 to 20 hours, until the alloys are in a desired temper. Each anneal may include slow cooling with a cooling rate of 20 to 200° F. per hour. Typically, there will be a series of cold rolling steps with intermediate anneals. After the alloys have been cold rolled to final gauge, the alloys may be stress relief annealed at temperatures between about 300 and about 750° F. for at least one hour.

While the processing of this alloy has been described as including a hot working step, this step may be omitted if not needed.

Illustrative examples of alloys in accordance with this first embodiment of the present invention include: (1) a copper base alloy consisting essentially of about 0.01 to about 0.25% by weight magnesium, about 0.01 to about 0.2% by weight phosphorous, about 0.001 to about 0.1% by weight silver, about 0.01 to about 0.25% by weight iron, up to 0.2% by weight of at least one of nickel and/or cobalt, up to about 0.2% by weight of a first addition selected from the group consisting of tin, silicon, and mixtures thereof, up to about 0.1% by weight of a second addition selected from the group consisting of calcium, boron, beryllium, zirconium, chromium, titanium, and mixtures thereof, and the balance copper and inevitable impurities; (2) a copper base alloy consisting essentially of about 0.01 to about 0.25% by weight magnesium, about 0.01 to about 0.2% by weight phosphorous, about 0.001 to less than about 0.05% by weight silver, about 0.01 to about 0.05% by weight iron, from about 0.05% to about 0.2% by weight of at least one of nickel and/or cobalt, up to about 0.2% by weight of a first addition selected from the group consisting of tin, silicon, and mixtures thereof, up to about 0.1% by weight of a second addition selected from the group consisting of calcium, boron, beryllium, zirconium, titanium, chromium, and mixtures thereof, and the balance copper and inevitable impurities; (3) a copper base alloy consisting essentially of about 0.01 to about 0.25% by weight magnesium, about 0.01 to about 0.2% by weight phosphorous, up to about 0.1% by weight silver, about 0.05 to about 0.20% by weight iron, from about 0.05% to about 0.2% by weight of at least one of nickel and/or cobalt, up to about 0.2% by weight of a first addition selected from the group consisting of tin, silicon, and mixtures thereof, up to about 0.1% by weight of a second addition selected from the group consisting of calcium, boron, beryllium, chromium, zirconium, titanium, and mixtures thereof, and the balance copper and inevitable impurities; and (4) a copper base alloy consisting essentially of about 0.01 to about 0.25% by weight magnesium, about 0.01 to about 0.2% phosphorous, about 0.001 to about 0.1% by weight silver, about 0.05 to about 0.25% by weight iron, about 0.05 to 0.2% by weight of at least one of nickel and cobalt, up to about 0.1% by weight of a first addition selected from the group consisting of boron, beryllium, calcium, chromium, titanium, zirconium, and mixtures thereof, up to about 0.2% by weight of a second addition selected from the group consisting of silicon, tin, and mixtures thereof, and the balance copper and inevitable impurities.

The following examples are offered to demonstrate the properties which can be obtained by the alloys of the present invention.

EXAMPLE I

A first alloy in accordance with the present invention, designated alloy A, containing 0.0807% magnesium, 0.0668% phosphorous, 0.0014% silver, 0.1121% iron and the balance copper and inevitable impurities was cast. A second alloy, designated alloy B, containing 0.108% magnesium, 0.068% phosphorous, 0.04% silver and the balance copper and inevitable impurities was cast. Both alloys were cast 9" thick. Thereafter, each alloy was hot rolled at 1554° F. down to 0.590", quenched, milled to 0.530", cold rolled to 0.157" and annealed at 790° F. for 4 hours. Following the anneal, the coils of the two alloys were cold rolled to 0.080" and annealed at 900° F. for a soak time of 7.5 hours; cold rolled to 0.040" and annealed at 850° F. for a soak time of 11 hours; and then cold rolled to gauges ranging from 0.0315" to 0.010".

The tensile strength and electrical conductivity for each alloy was determined at the different gauges. The results are set forth in the table I.

TABLE I

| | TENSILE STRENGTH (ksi) | | ELEC. COND. (% IACS) | | STRENGTH-COND. FACTOR | |
|---|---|---|---|---|---|---|
| GAUGE | ALLOY A | ALLOY B | ALLOY A | ALLOY B | ALLOY A | ALLOY B |
| .040" | 45.7 | 41.4 | 95.11 | 93.52 | 4347 | 3872 |
| .0315" | 58.4 | 53.7 | 95.72 | 94.06 | 5590 | 5051 |
| .025" | 63.8 | 60.9 | 94.67 | 94.05 | 6040 | 5728 |
| .020" | 67.7 | 64.7 | 94.69 | 93.61 | 6411 | 6057 |
| .016 | 69.3 | 68.2 | 93.21 | 92.87 | 6459 | 6334 |
| .0127" | 72.7 | 70 | 91.73 | 91.03 | 6669 | 6372 |
| .010" | 74 | 71.5 | 91.21 | 89.47 | 6750 | 6397 |

The foregoing shows the following:

i) the tensile strength of the alloy of the present invention is consistently higher than the other alloy at each temperature. The differences are especially significant in view of the alloys being very lean with conductivity approaching pure copper.

ii) the electrical conductivity of the alloy of the present invention is consistently higher at similar reduction and temper.

iii) the strength conductivity factor for each temper is significantly higher for the alloy of the present invention. The average for the alloy of the present invention is approximately 7% higher than that for the other alloy. This is especially significant since the other alloy already represents the peak of strength and conductivity for existing high conductivity copper alloys.

EXAMPLE II

An alloy in accordance with the present invention having the composition set forth in Example I was taken at 0.160" soft, rolled to 0.030", annealed at 900° F. for 10 hours, and then rolled to 0.003" gauge. The alloy so processed demonstrated a tensile strength of 82.65 ksi, an elongation of 3.0%, an electrical conductivity of 90.15% IACS, and a strength×conductivity factor of 7,451. This represents approximately 24% improvement in strength×conductivity combination for pure copper and approximately 16.5% improvement over the best currently available alloys.

EXAMPLE III

Although lean copper alloys have a good combination of strength and conductivity, one area in which these alloys have a problem is in resistance to softening at elevated temperatures. In many applications, the parts are exposed to relatively high temperature for short duration of the order of a few minutes. The strength remaining after this exposure to heat is very important in these applications.

Samples of alloys A and B, as set forth in Example I, at different tempers (as rolled and 3 min. in salt bath) were subjected to two different temperatures for three minutes each. The first temperature was 710° F. and the second temperature was 800° F. Table II shows the results.

TABLE II

| | Alloy A Tensile Strength (KSI) | | | Alloy B Tensile Strength (KSI) | | |
|---|---|---|---|---|---|---|
| Gauge | As | After Treatment | | As | After Treatment | |
| (In.) | Rolled | 710° F. | 800° F. | Rolled | 710° F. | 800° F. |
| .010 | 74 | 67.8 | 65.2 | 71.5 | 65.9 | 45.9 |
| .0125 | 72.7 | 66.5 | 64.5 | 70 | 64.6 | 49.4 |
| .016 | 69.3 | 63.7 | 61.9 | 68.2 | 62.1 | 55.0 |
| .020 | 67.7 | 61.8 | 60.6 | 64.7 | 59.3 | 56.8 |
| .025 | 63.8 | 58.4 | 57.1 | 60.9 | 55.8 | 54.0 |
| .0315 | 58.4 | 53.7 | 52.9 | 53.7 | 49.4 | 48.8 |

The foregoing results show higher strength for the alloy in accordance with the present invention after exposure at 710° F. and 800° F. In the case of exposure to 800° F., the alloy in accordance with the present invention shows only a small incremental drop vs. 710° F., with all tempers having a retained strength that is within 10–12% of the startup strength. The other alloy shows a drop in strength which ranges from 10 to 35%. Clearly, these results show that alloys in accordance with the present invention demonstrate an improved resistance to thermal softening.

EXAMPLE IV

Samples of alloys described in Example I were tested for formability by bending the samples at a width that equals 10× the thickness for goodway and badway bends at 900 and 1800. The results for two different tempers, extra hard and extra spring, are shown in Table III below. As used in Table III, the term "MBR/t" refers to the lowest radius for making bends without cracks.

TABLE III

| | | Bends Goodway | | Bends Badway | |
|---|---|---|---|---|---|
| Alloy | T.S. (ksi) | 90° MBR/t | 180° MBR/t | 90° MBR/t | 180° MBR/t |
| A | 67.7 | 0 | 0.5 | 0 | 1 |
| B | 64.7 | 0 | 0.5 | 0 | 1 |
| A | 72.7 | 0 | 0.5 | 0.5 | 2 |
| B | 70.0 | 0 | 0.5 | 0.5 | 2 |

The above results show that the alloy of the present invention retains favorable formability while having higher strength.

The microstructures of alloys of Example I were also examined. It was found that alloy A had twice as many magnesium phosphide particles as alloy B. Further, the number of iron phosphide particles in alloy A were double the number of magnesium phosphide particles.

Another embodiment of an alloy in accordance with the present invention is a copper base alloy which consists essentially of magnesium in an amount from about 0.005 to about 0.25% by weight, phosphorous in an amount from about 0.005 to about 0.2% by weight, at least one element selected from the group consisting of nickel, cobalt, and mixtures thereof in an amount from about 0.05 to about 0.2% by weight, preferably in an amount from about 0.11% to about 0.20% by weight, and the balance copper and inevitable impurities. These alloys typically have phosphide particles uniformly distributed throughout the alloy matrix, which phosphide particles have a peak size of about 0.2 microns. These phosphide particles, while strengthening the alloys, cause no harm to their formability and ductility.

If desired, silver in an amount from about 0.001 to about 0.1% by weight can be added to the alloy.

These alloys may include at least one additional element selected from the group consisting of tin, silicon, and mixtures thereof. This at least one additional element may be included in amounts less than about 0.2% by weight. Typically, when one of these elements is added, it is added in a minimum amount of about 0.001% by weight.

These alloys may also include up to about 0.1% by weight of at least one additional element selected from the group consisting of boron, beryllium, calcium, zirconium, chromium, titanium, and mixtures thereof.

If desired, iron in an amount from about 0.01% to about 0.05% by weight can be added to these alloys to improve their strength.

Nickel and/or cobalt in the aforesaid amounts are desirable additives since they improve strength by refining the grain. Additionally, they have a positive effect on conductivity. When cobalt is added, it is preferred that it be added in an amount so that the Co:P ratio is between about 4:1 and about 6:1.

The aforesaid phosphorous addition allows the metal to stay deoxidized, making it possible to cast sound metal within the limits set for phosphorous. With thermal treatment of the cast alloys, phosphorous forms a phosphide with nickel and magnesium and/or cobalt and magnesium and/or a combination of these elements which significantly reduces the loss in electrical conductivity that would result if these materials were entirely in solid solution in the matrix. For example, 0.01% phosphorous in solid solution would decrease the electrical conductivity by 8% IACS. 0.01% cobalt in solution would decrease the electrical conductivity by another 4.0% IACS. 0.01% nickel in solution would decrease the electrical conductivity by another 1.0% IACS. Thus, in order to achieve electrical conductivities of 90% IACS and greater, minimal amounts of phosphorous and the other alloying elements must be present in solution.

To accomplish the foregoing goal, magnesium is added to the alloys in the aforesaid ranges. The magnesium is further added so that the Mg:P ratio is greater than 1.0. Further, the composition of alloying elements is selected so that the elements in order of effect on conductivity, P, Co and/or Ni (where added) are present to the maximum extent as phosphides with none or a minimal amount of them in solution. Magnesium, on the other hand, which causes minimal drop in electrical conductivity when left in solution, is added in a proportion which causes some residual amount of magnesium to be left in solution. This residual magnesium ensures that any phosphorous that is not tied up with elements like cobalt and nickel, will be tied up by the magnesium (form magnesium phosphide particles).

The alloys of the present invention are thermally treated to form magnesium phosphide particles in the range of about 500–about 2000 Angstroms. The magnesium phosphide particles are uniformly distributed throughout the alloy matrix.

Alloys formed in accordance with the present invention in a cold worked condition exhibit a strength in excess of 80 ksi with an electrical conductivity of 90% IACS. The electrical conductivity of the alloys of the present invention, when in soft temper, can reach over 95% IACS.

Alloys in accordance with the present invention may be processed as shown in the FIGURE. The alloys may be cast using any suitable continuous or non-continuous casting technique known in the art. For example, the alloy could be cast using horizontal casting techniques, direct-chill casting techniques, vertical casting techniques, and the like. After casting, the alloys may be hot worked at a temperature in the range of about 1200° F. to about 1600° F. to a desired gauge. The hot working may comprise any suitable technique known in the art including but not limited to hot rolling. Typical gauges for the material after hot working are in the range of from about 0.400 inches to about 0.600 inches.

Following hot working, the alloys may be quenched, if needed, and homogenized, if needed, at a temperature of from about 1200° F. to about 1600° F. for at least one hour. Thereafter, they may be milled to remove material from 0.020 inches to about 0.050 inches per side. Any quenching, homogenizing, and milling may be carried out using any suitable equipment and technique known in the art.

Following milling, the alloys of the present invention may be subjected to cold working, such as cold rolling from the milled to finish gauge, with at least one annealing operation in the temperature range of about 700° F. to about 1200° F. for a time ranging from 1 to 20 hours, until the alloys are in a desired temper. Each anneal may include slow cooling with a cooling rate of 20 to 200° F. per hour. Typically, there will be a series of cold rolling steps with intermediate anneals. After the alloys has been cold rolled to final gauge, the alloys may be stress relief annealed at temperatures between about 300 and about 750° F. for at least one hour.

While the processing of this alloy has been described as including a hot working step, this step can be omitted if not needed.

Illustrative examples of alloys which can be made in accordance with this alternative embodiment of the present invention include: (1) a copper base alloy consisting essentially of about 0.07 to about 0.25% by weight magnesium, from about 0.01 to about 0.2% by weight phosphorous, at least one of nickel and cobalt in an amount up to about 0.2% by weight and the balance copper and inevitable impurities with the magnesium to phosphorous ratio being greater than 1.0; and (2) a copper base alloy consisting essentially of about 0.005 to less than about 0.06% by weight magnesium, about 0.005 to less than about 0.05% by weight phosphorous, at least one of nickel and cobalt in an amount up to about 0.2% by weight, less than about 0.05% by weight iron, and the balance copper and inevitable impurities with the magnesium to phosphorous ratio being greater than 1.0.

The higher strength, higher conductivity, good formability, and increased resistance to softening of the alloys of the present invention when compared to other alloys is explained by the increased precipitation of magnesium and phosphorous. With regard to the first alloy embodiment set forth above, the improvement of these properties is also due to the tying up of more phosphorous as iron phosphides and the presence of iron phosphides in the aforementioned particle sizes.

It is apparent that there has been provided in accordance with this invention a copper-magnesium-phosphorous alloy which fully satisfies the means, objects and advantages set forth hereinbefore. While the present invention has been described in the context of specific embodiments thereof, other variations, alternatives, and modifications will become apparent to one of skill in the art after reading the instant description. Therefore, it is intended to embrace such alternatives, variations, and modifications as fall within the broad scope of the appended claims.

What is claimed is:

1. A process for forming a copper base alloy having an electrical conductivity of at least 90% IACS and a tensile strength of 80 ksi comprising the steps of:

casting an alloy consisting essentially of magnesium in an amount from about 0.1 to about 0.25% by weight, phosphorous in an amount from about 0.01 to about 0.2% by weight, silver in an amount from about 0.001 to about 0.1% by weight, iron in an amount from about 0.01 to about 0.25% by weight, and the balance copper and inevitable impurities with a ratio of magnesium to phosphorous. Mg:P, of at least 1.0; and thermally treating said cast alloy to form magnesium phosphide particles in the range of about 500 to about 2000 Angstroms and to form coarse iron phosphide particles in the range of from about 1000 to about 2000 Angstroms and finer iron phosphide particles in the range of from about 250 to about 600 Angstroms.

2. A process according to claim 1, wherein said thermal treatment step comprises at least one of quenching said cast alloy and homogenizing said alloy at a temperature in the range of about 1200° F. to about 1600° F. for at least one hour.

3. A process according to claim 1, wherein said thermal treatment step comprises hot working said cast alloy at a temperature of about 1200° F. to about 1600° F.

4. A process according to claim 3, wherein said thermal treatment step further comprises cold working said alloy to a finished gauge.

5. A process according to claim 4, wherein said cold working step comprises performing multiple cold rolling steps with at least one intermediate anneal at a temperature range of about 700° F. to about 1200° F. for a time ranging from 1 to 20 hours.

6. A process according to claim 5, further comprising slow cooling said alloy at a rate of 20 to 200° F. per hour after each said anneal.

7. A process according to claim 5, further comprising stress relief annealing said alloy at finish gauge at a temperature between about 300° F. and about 750° F. for at least one hour.

8. A process for forming a copper base alloy having an electrical conductivity of at least 90% IACS and a tensile strength of 80 ksi comprising the steps of:

casting an alloy consisting essentially of magnesium in an amount from about 0.07to about 0.25% by weight, phosphorous in an amount from about 0.01 to about 0.2% by weight, at least one clement selected from the group consisting of nickel, cobalt, and mixtures thereof in an amount effective to increase strength by grain refinement and phosphide formation up to about 0.2% by weight, up to about 0.5% by weight iron, and the balance copper and inevitable impurities and having a magnesium to phosphorous ratio of at least 1.0; and thermally treating said cast alloy to form magnesium phosphide particles in the range of about 500 to about 2000 Angstroms uniformly distributed throughout the matrix of the alloy.

9. A process according to claim 8, wherein said thermal treatment step comprises at least one of quenching said cast alloy and homogenizing said alloy at a temperature in the range of about 1200° F. to about 1600° F. for at least one hour.

10. A process according to claim 8, wherein said thermal treatment step comprises hot working said cast alloy at a temperature of about 1200° F. to about 1600° F.

11. A process according to claim 8, wherein said thermal treatment step further comprises cold working said alloy to a finished gauge.

12. A process according to claim 11, wherein said cold working step comprises performing multiple cold rolling steps with at least one intermediate anneal at a temperature range of about 700° F. to about 1200° F. for a time ranging from 1 to 20 hours.

13. A process according to claim 12, further comprising slow cooling said alloy at a rate of 20 to 200° F. per hour after each said anneal.

14. A process according to claim 12, further comprising stress relief annealing said alloy at finish gauge at a temperature between about 300° F. and about 750° F. for at least one hour.

* * * * *

UNITED STATES PATENT AND TRADEMARK OFFICE

CERTIFICATE OF CORRECTION

PATENT NO. : 6,689,232 B2
DATED : February 10, 2004
INVENTOR(S) : Ashok K. Bhargava It is certified that error appears in the above-identified patent and that said Letters Patent is hereby corrected as shown below:

Title page,
After Item "[76] Inventor: Ashok K. Bhargava, 393 Charles Dr., Cheshire, CT (US) 06410" please insert -- [73] Assignee: Waterbury Rolling Mills, Inc., Waterbury, CT --

After "*Primary Examiner*-- Sikyin Ip", please insert

-- *Attorney, Agent, or Firm*– Gregory S. Rosenblatt, Wiggin and Dana LLP --

Signed and Sealed this

Eleventh Day of May, 2004

JON W. DUDAS
*Acting Director of the United States Patent and Trademark Office*